US008670696B2

(12) United States Patent
Kim et al.

(10) Patent No.: US 8,670,696 B2
(45) Date of Patent: Mar. 11, 2014

(54) DEVELOPING DEVICE USABLE WITH IMAGE FORMING APPARATUS

(71) Applicant: Samsung Electronics Co., Ltd, Suwon-si (KR)

(72) Inventors: Sung han Kim, Suwon-si (KR); In Cheol Jeon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/859,043

(22) Filed: Apr. 9, 2013

(65) Prior Publication Data

US 2013/0223890 A1 Aug. 29, 2013

Related U.S. Application Data

(63) Continuation of application No. 12/851,715, filed on Aug. 6, 2010, now Pat. No. 8,437,666.

(30) Foreign Application Priority Data

Sep. 1, 2009 (KR) ..... 10-2009-0081744

(51) Int. Cl.
*G03G 15/08* (2006.01)

(52) U.S. Cl.
USPC ..... 399/254

(58) Field of Classification Search
USPC ..... 399/254–256, 119
See application file for complete search history.

(56) References Cited

U.S. PATENT DOCUMENTS

| | | | | |
|---|---|---|---|---|
| 7,697,869 | B2 * | 4/2010 | Okimura et al. | 399/258 |
| 7,907,874 | B2 * | 3/2011 | Okoshi | 399/258 |
| 2006/0222412 | A1 * | 10/2006 | Ito et al. | 399/258 |
| 2007/0258732 | A1 * | 11/2007 | Tanaka | 399/254 |
| 2007/0264051 | A1 * | 11/2007 | Tanaka | 399/254 |
| 2007/0280739 | A1 * | 12/2007 | Tanaka | 399/254 |
| 2008/0145105 | A1 * | 6/2008 | Iwamura | 399/254 |
| 2010/0104325 | A1 * | 4/2010 | Moon et al. | 399/260 |

FOREIGN PATENT DOCUMENTS

| | | |
|---|---|---|
| JP | 2007140313 | 6/2007 |
| JP | 2009186832 | 8/2009 |

OTHER PUBLICATIONS

Korean Office Action issued Mar. 9, 2011 in KR Application No. 10-2009-0081744.

* cited by examiner

*Primary Examiner* — Walter L Lindsay, Jr.
*Assistant Examiner* — Rodney Bonnette
(74) *Attorney, Agent, or Firm* — Stanzione & Kim, LLP

(57) ABSTRACT

A developing device usable with an image forming apparatus, which has an improved configuration to allow smooth flow of developer stored therein. The developing device includes a housing in which a developer receiving chamber is defined, a partition to divide the developer receiving chamber into a first developer receiving chamber and a second developer receiving chamber, and a first developer delivery member arranged in the first developer receiving chamber to deliver developer in a first direction. The partition includes at least one opening to communicate the first developer receiving chamber and the second developer receiving chamber with each other, and a shield to block between the first developer receiving chamber and the second developer receiving chamber at an upstream position of the first direction so as to isolate the two developer receiving chambers from each other.

7 Claims, 6 Drawing Sheets

DEVELOPING DEVICE USABLE WITH IMAGE FORMING APPARATUS

CROSS-REFERENCE TO RELATED APPLICATIONS

This is a Continuation Application of prior application Ser. No. 12/851,715, filed on Aug. 6, 2010 in the United States Patent and Trademark Office, which claims the benefit of Korean Patent Application No. 2009-0081744, filed on Sep. 1, 2009 in the Korean Intellectual Property Office, the disclosure of which is incorporated herein by reference in its entirety.

BACKGROUND

1. Field of the Invention

Embodiments of the present general inventive concept relate to a developing device usable with an electro-photographic image forming apparatus.

2. Description of the Related Art

Generally, image forming apparatuses are devised to form an image on a printing medium according to inputted image signals. Examples of image forming apparatuses include printers, copiers, facsimiles, and so-called multi-functional devices that combine some of the functionalities of the aforementioned devices.

An electro-photographic image forming apparatus as a kind of the aforementioned image forming apparatuses includes a photosensitive body, a light scanning device, and a developing device. The light scanning device irradiates light to a surface of a photosensitive body that has been charged by a predetermined electric potential, thereby forming an electrostatic latent image on the surface of the photosensitive body. The developing device supplies developer to the electrostatic latent image, thereby forming a visible image.

The visible image formed on the photosensitive body is directly transferred to the printing medium or is indirectly transferred to the printing medium by way of an intermediate transfer device. After being subjected to a fusing process, the printing medium, on which the image has been completely printed, is discharged out of the image forming apparatus.

Generally, the developing device includes a developer receiving chamber to store developer, and a developer delivery device and a developing member arranged in the developer receiving chamber. The developer delivery device delivers the developer from the developer receiving chamber to the developing member. The developing member supplies the developer to the photosensitive body, enabling formation of a visible image.

SUMMARY

Embodiments of the present general inventive concept provide a developing device usable with an image forming apparatus, which has an improved configuration to assure smooth flow of developer stored therein.

Additional features and utilities of the present general inventive concept will be set forth in part in the description which follows and, in part, will be obvious from the description, or may be learned by practice of the embodiments of the present general inventive concept.

Embodiments of the present general inventive concept can be achieved by providing a developing device usable with an image forming apparatus which includes a housing in which a developer receiving chamber is defined, a partition to divide the developer receiving chamber into a first developer receiving chamber and a second developer receiving chamber, and a first developer delivery member arranged in the second developer receiving chamber to deliver developer in a first direction, wherein the partition includes a developer supply port to allow the developer to be supplied from the first developer receiving chamber to the second developer receiving chamber during operation of the developing device, at least one opening to communicate the first developer receiving chamber and the second developer receiving chamber with each other, and a shield to block between the first developer receiving chamber and the second developer receiving chamber at an upstream position of the first direction so as to isolate the two developer receiving chambers from each other.

The developing device may further include a second developer delivery member arranged in the second developer receiving chamber to deliver the developer in a second direction so as to transmit the developer to the first developer delivery member, and a developer delivery port to communicate downstream of the second developer delivery member with upstream of the first developer delivery member, and the shield may be formed at a position corresponding to the developer delivery port.

A length of the shield may be longer than a length of the developer delivery port with respect to the first direction.

The developing device may further include a barrier arranged at a position corresponding to an upstream end of the first developer delivery member between the first developer delivery member and the second developer delivery member.

The partition may include a first section extending vertically from the bottom of the housing, a second section bent from the first section to divide the developer receiving chamber vertically, and a third section extending vertically from the second section, and the shield may be formed at one end of the third section with respect to the first direction.

The at least one opening may be formed in the third section.

The at least one opening may include a plurality of openings arranged in the first direction.

Embodiments of the present general inventive concept can also be achieved by providing a developing device usable with an image forming apparatus which includes a housing in which a developer receiving chamber is defined, a partition to divide the developer receiving chamber into a first developer receiving chamber and a second developer receiving chamber, a dividing wall to divide the second developer receiving chamber into a developer delivery chamber and a developing chamber, a developer supply port formed in the partition to allow the developer to be moved from the first developer receiving chamber to the developer delivery chamber, a developer delivery port formed in the dividing wall to allow the developer to be moved from the developer delivery chamber to the developing chamber, a first developer delivery member arranged in the developing chamber to deliver the developer having passed through the developer delivery port, a second developer delivery member arranged in the developer delivery chamber to deliver the developer toward the developer delivery port, at least one opening formed in the partition to communicate the first developer receiving chamber and the developing chamber with each other, and a shield formed at the partition at a position corresponding to the developer delivery port so as to isolate the first developer receiving chamber and the developing chamber from each other.

A length of the shield may be longer than a length of the developer delivery port with respect to a developer delivery direction of the first developer delivery member.

The at least one opening may be formed downstream of the shield with respect to a developer delivery direction of the first developer delivery member.

The partition may include a first section arranged between the first developer receiving chamber and the developer delivery chamber, a second section bent from the first section toward the developing chamber and having a developer seat formed on an upper surface thereof, and a third section arranged between the first developer receiving chamber and the developing chamber, and the shield may be formed at one end of the third section with respect to a developer delivery direction of the first developer delivery member.

The first developer delivery member may include a sealing member coupled to an end thereof to prevent the developer from leaking out of the developing device, and the dividing wall may include a barrier arranged at a position corresponding to the sealing member between the first developer delivery member and the second developer delivery member.

Embodiments of the present general inventive concept can also be achieved by providing a developing device usable with an image forming apparatus which includes a housing in which a developer receiving chamber is defined, a partition to divide the developer receiving chamber into a first developer receiving chamber and a second developer receiving chamber and having a developer seat and a developer supply port formed in the developer seat, a developer delivery belt arranged in the first developer receiving chamber to deliver developer to the developer seat, a developer supply member arranged on the developer seat to deliver the developer to the developer supply port, a first developer delivery member and a second developer delivery member rotatably supported in the housing to deliver the developer in different directions within the second developer receiving chamber, a dividing wall to separate the first developer delivery member and the second developer delivery member from each other, the dividing wall having a developer delivery port formed at one end thereof to allow passage of the developer, at least one opening formed in the partition to communicate the first developer receiving chamber and the developing chamber with each other, and a shield formed at the partition at a position corresponding to the developer delivery port so as to isolate the first developer receiving chamber and the developing chamber from each other.

The shield may be arranged above the developer seat.

The at least one opening may be arranged above the developer seat.

The first developer delivery member may include a delivery blade formed in an axial direction thereof, and a sealing member coupled to an end thereof to prevent the developer from leaking out of the developing device, and the dividing wall may include a barrier arranged at a position corresponding to the sealing member between the first developer delivery member and the second developer delivery member.

The developing device may further include a photosensitive body, a developing roller arranged in the second developer receiving chamber to supply the developer to the photosensitive body, and a supply roller arranged in the second developer receiving chamber to supply the developer to the developing roller, and the first developer delivery member may be arranged between the supply roller and the second developer delivery member.

Embodiments of the present general inventive concept can also be achieved by providing a developing device usable with an image forming apparatus, the developing device comprising: a housing including a developer receiving chamber therein, the developer receiving chamber being divided into a first part and a second part; a partition to divide the developer receiving chamber into the first and second parts, the partition including: a developer supply port to allow developer to be supplied from the first part to the second part during operation thereof, and a plurality of openings to communicate the first part with the second part; a first developer delivery member disposed in the second part of and including a delivery mechanism disposed along a predetermined portion thereof to deliver developer in a first direction; a second developer delivery member disposed in the second part and including a delivery mechanism disposed along a predetermined portion thereof to deliver developer in an opposite direction than the first direction; and a dividing wall disposed between the first and second developer delivery members, the dividing wall comprising: a developer delivery port to deliver developer from the first developer delivery member to the second developer delivery member and disposed at a predetermined position with respect to the disposition of the delivery mechanism of at least one of the first and second delivery members, and a developer circulation port to return unused developer from the second developer delivery member to the first developer delivery member.

In an embodiment, the first developer delivery member and delivery mechanism may comprise a shaft including a sealing member at an end thereof and a blade extending rotationally from the sealing member along the length of the shaft such that the developer delivery port is disposed to face the blade adjacent to the sealing member.

The developer circulation port may be disposed on the dividing wall farthest from the sealing member of the first developer delivery member.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

The above and/or other features and utilities of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
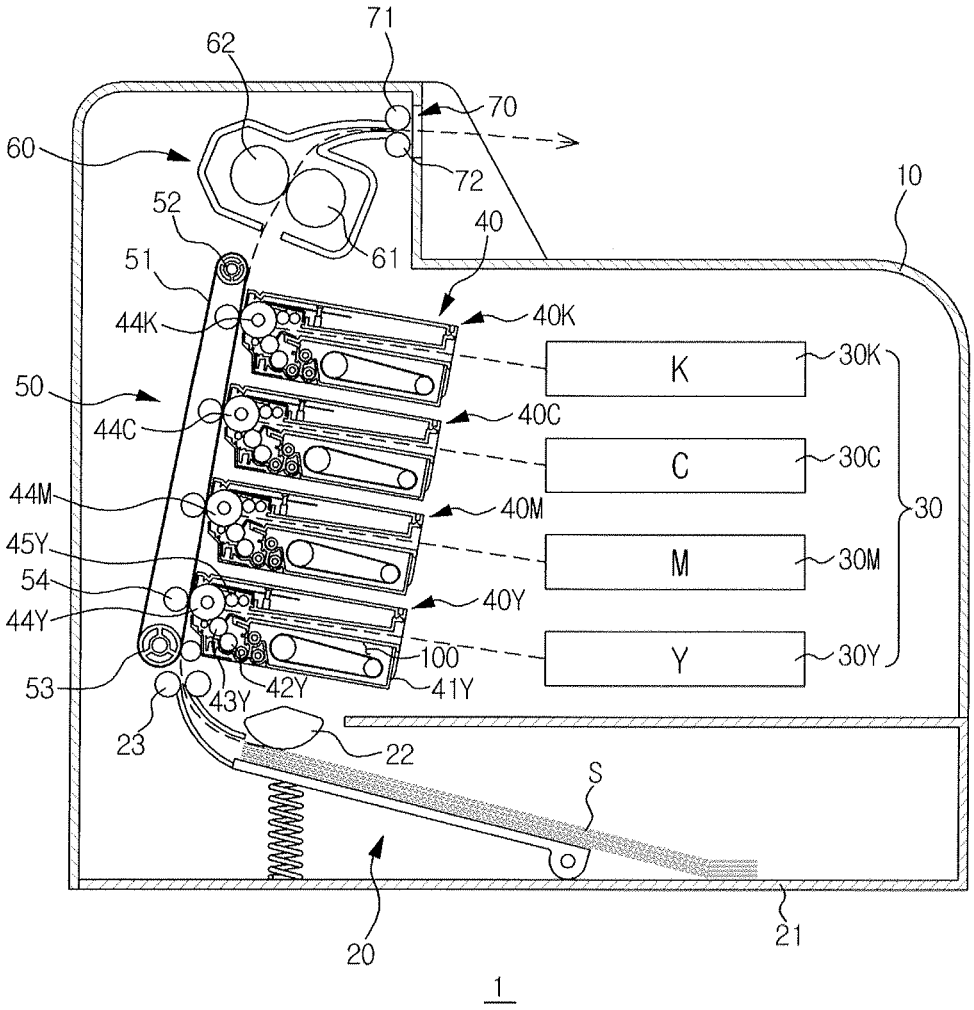
FIG. 1 is a view illustrating a configuration of an image forming apparatus having a developing device according to an embodiment of the present general inventive concept.

Reference will now be made in detail to the embodiments of the present general inventive concept, examples of which are illustrated in the accompanying drawings, wherein like reference numerals refer to like elements throughout.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a view illustrating a configuration of an image forming apparatus having a developing device according to an embodiment of the present general inventive concept.

As shown in FIG. 1, the image forming apparatus 1 includes a body 10, a printing medium supply unit 20, a light scanning unit 30, a developing unit 40, a transfer unit 50, a fusing unit 60, and a printing medium discharge unit 70.

The body 10 defines an external appearance of the image forming apparatus 1 and supports a variety of elements mounted therein.

The printing medium supply unit 20 includes a cassette 21 in which printing media S is stored, a pickup roller 22 to pick up the printing media S stored in the cassette 21 sheet by sheet, and delivery rollers 23 to deliver the picked-up printing medium toward the transfer unit 50.

The light scanning unit 30 includes four light scanning devices 30Y, 30M, 30C, and 30K to irradiate light, corresponding to Yellow, Magenta, Cyan, and Black image information according to printing signals, to respective photosensitive bodies 44Y, 44M, 44C, and 44K of developing devices 40Y, 40M, 40C, and 40K that will be described hereinafter. With the light irradiated by the four light scanning devices 30Y, 30M, 30C, and 30K, electrostatic latent images are formed on the respective photosensitive bodies 44Y, 44M, 44C and 44K.

The developing unit 40 includes the four developing devices 40Y, 40M, 40C and 40K, in which different colors of developers, for example, yellow (Y), magenta (M), cyan (C) and black (K) developers are received respectively. Although the developing device 40Y in which a yellow developer (Y) is received will be described hereinafter by way of example, it will be appreciated that the following description is applicable to the other three developing devices 40M, 40C and 40K in which magenta (M), cyan (C) and black (K) developers are received respectively although this is not specially mentioned.

The developing device 40Y includes a housing 41Y, a developer receiving chamber 100, a supply roller 42Y, a developing roller 43Y, and the photosensitive body 44Y.

The developer receiving chamber 100 is defined in the interior of the housing 41Y and stores the developer to be supplied to the photosensitive body 44Y. The supply roller 42Y is mounted in the housing 41Y and supplies the developer stored in the developer receiving chamber 100 to the developing roller 43Y. The developing roller 43Y attaches the developer to a surface of the photosensitive body 44Y on which an electrostatic latent image has been formed by the light scanning device 30Y, so as to form a visible image. The photosensitive body 44Y is rotatably coupled to a tip end of the housing 41Y and receives the developer from the developing roller 43Y. Although the present embodiment describes the photosensitive body 44Y integrally coupled to the developing device 40Y, in another embodiment, the photosensitive body 44Y may be separated from the developing device 40Y.

Reference numeral 45Y represents a charging roller to charge the photosensitive body 44Y with a predetermined electric potential before the light scanning device 30 irradiates light to the photosensitive body 44Y.

The transfer unit 50 serves to transfer the visible image formed on the photosensitive body 44Y to the printing medium. The transfer unit 50 includes a printing medium delivery belt 51, a driving roller 52, a driven roller 53, and a plurality of transfer rollers 54.

The printing medium delivery belt 51 delivers the printing medium supplied from the printing medium supply unit 20 to each of the plurality of photosensitive bodies 44Y, 44M, 44C, and 44K.

The driving roller 52 and the driven roller 53 are arranged inside the printing medium delivery belt 51 at opposite ends thereof, and act to rotate the printing medium delivery belt 51 in an endless orbit.

The plurality of transfer rollers 54 is arranged opposite the respective photosensitive bodies 44Y, 44M, 44C and 44K with the printing medium delivery belt 51 interposed therebetween, so that the visible image formed on each of the photosensitive bodies 44Y, 44M, 44C and 44K is transferred to the printing medium delivered by the printing medium delivery belt 51.

The fusing unit 60 includes a heating roller 61 having a heating source, and a press roller 62 arranged opposite the heating roller 61. When the printing medium passes between the heating roller 61 and the press roller 62, the transferred image is fused to the printing medium by heat conducted from the heating roller 61 and pressure acting between the heating roller 61 and the press roller 62.

The printing medium discharge unit 70 includes a paper discharge roller 71 and a paper backup roller 72 and discharges the printing medium, having passed through the fusing unit 60, out of the body 10.

Figure 2:
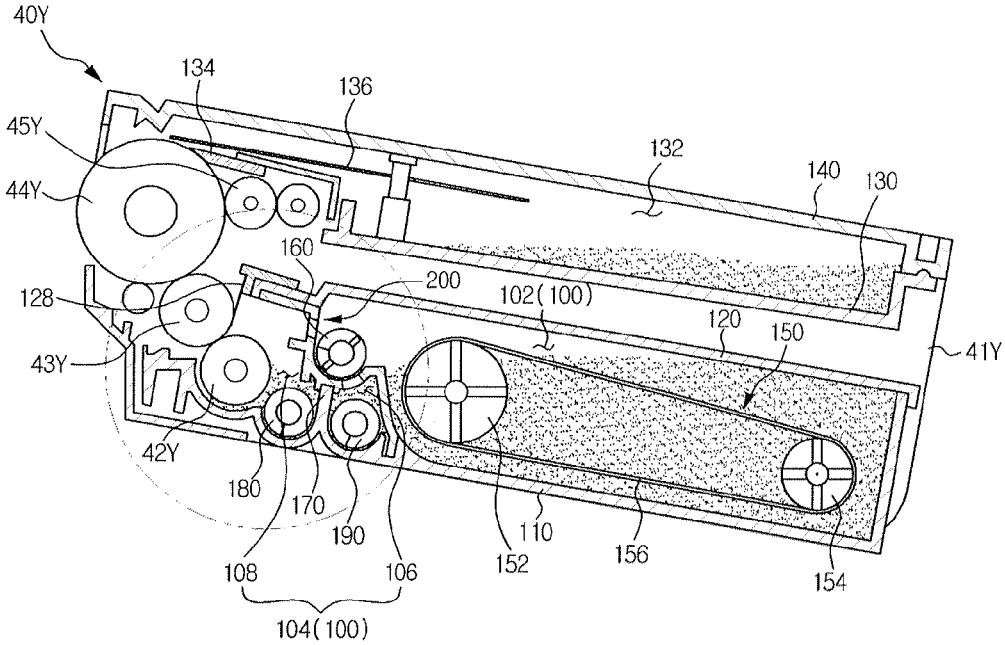
FIG. 2 is a sectional view illustrating the developing device according to the embodiment of the present general inventive concept.
Figure 3:
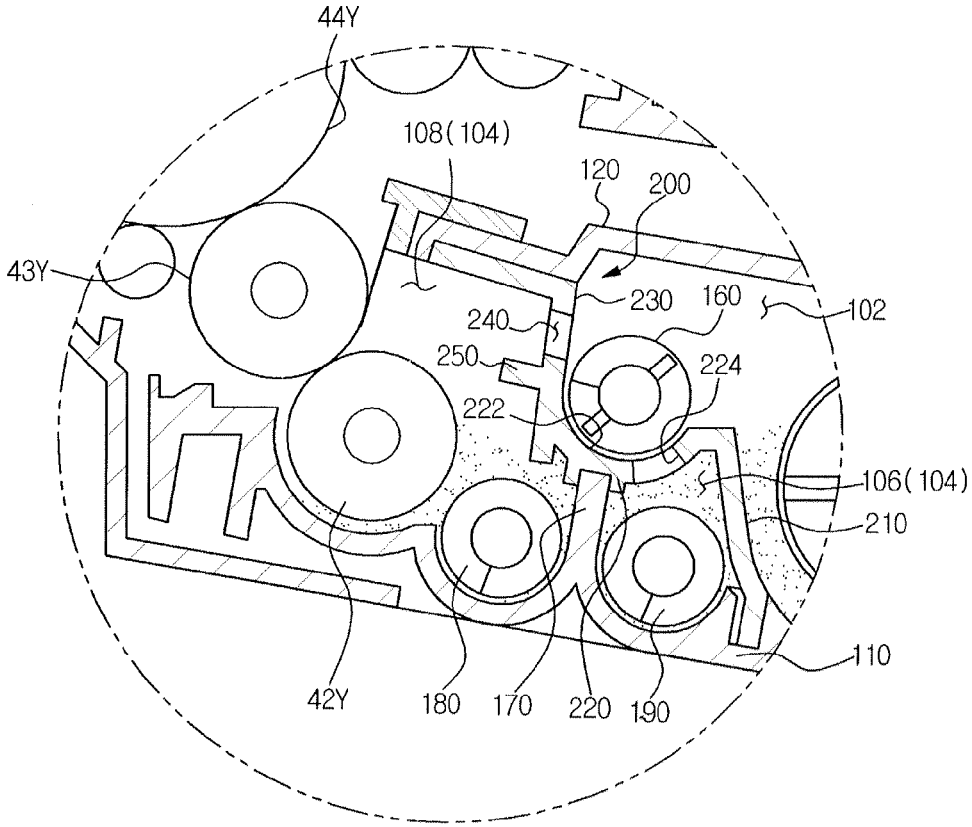
FIG. 3 is a partial enlarged view of FIG. 2.
Figure 4:
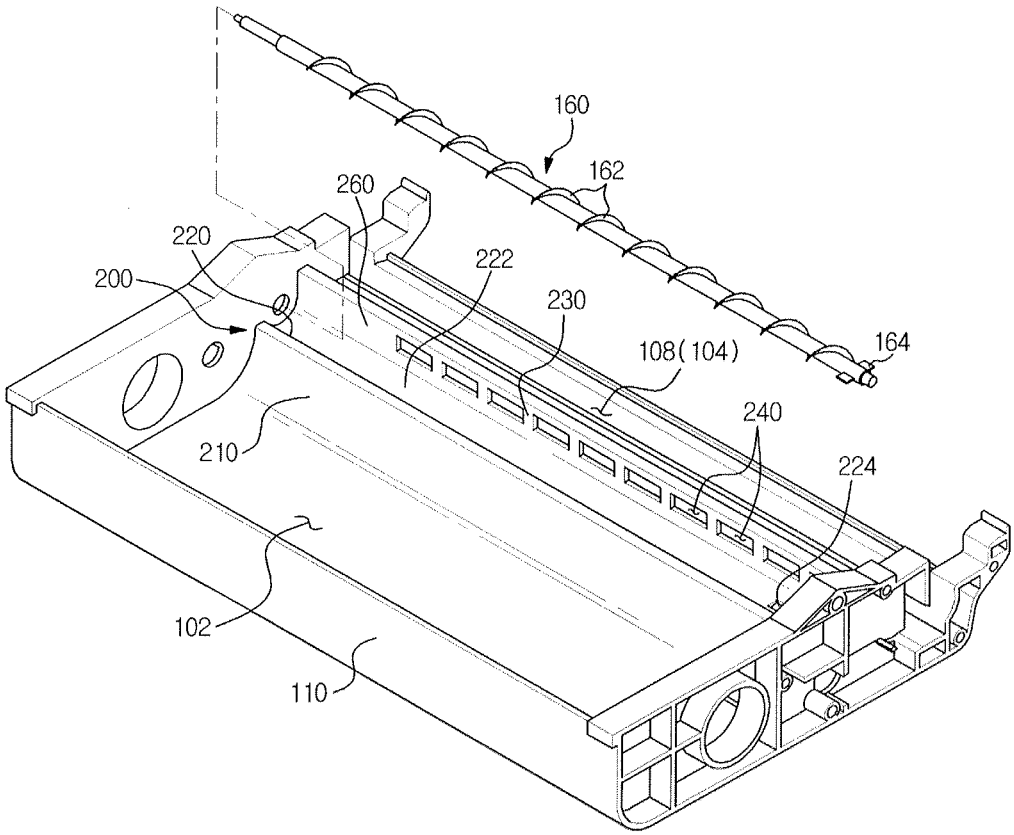
FIG. 4 is a perspective view illustrating some constituent elements of FIG. 2.

FIG. 2 is a sectional view illustrating the developing device according to the embodiment of the present general inventive concept, and FIG. 3 is a partial enlarged view of FIG. 2, and FIG. 4 is a perspective view illustrating some constituent elements shown in FIG. 2.

As shown in FIGS. 2 to 4, the housing 41Y includes a base frame 110, a cover 120, an upper frame 130, and an upper cover 140.

The base frame 110 supports a variety of elements received therein. The cover 120 is configured to cover a top of the base frame 110 and is coupled with the base frame 110 to define the developer receiving chamber 100 for storage of the developer together.

The upper frame 130 and the upper cover 140 are arranged above the cover 120 and define a waste developer receiving chamber 132 for storage of waste developer collected from the photosensitive body 44Y.

The upper frame 130 is provided with a cleaning member 134. The cleaning member 134 scrapes away the developer remaining on the surface of the photosensitive member 44Y. The waste developer removed by the cleaning member 134 is delivered by a waste developer delivery member 136 and is stored in the waste developer receiving chamber 132.

The waste developer delivery member 136 is arranged above the cleaning member 134. The waste developer delivery member 136 may have a plate shape and may be formed of a plastic molded product or a film having high restoration elasticity. Providing the plate-shaped waste developer delivery member 136 may reduce a height of the developing device 40Y, enabling efficient delivery of waste developer even if a height of the waste developer receiving chamber 132 is reduced.

The developer receiving chamber 100 is divided into a first developer receiving chamber 102 and a second developer receiving chamber 104 by a partition 200. The first developer receiving chamber 102 stores the developer therein, and the second developer receiving chamber 104 accommodates a variety of constituent elements required to supply the developer to the photosensitive body 44Y, such as the supply roller 42Y, and the developing roller 43Y, etc.

The partition 200 is arranged between the first developer receiving chamber 102 and the second developer receiving chamber 104. The partition 200 is configured to prevent all the developer from being moved from the first developer receiving chamber 102 to the second developer receiving chamber 104, so as to reduce stress applied to the developer when a great amount of developer is concentrated into the second developer receiving chamber 104. In other words, the partition 200 provides the benefit of preventing too much weight being applied to developer resting in the second developer receiving chamber 104. The partition 200 also serves to prevent developer, which has been deteriorated by a temperature and pressure near the supply roller 42Y and the developing roller 43Y, from flowing backward toward the first developer receiving chamber 102, and to enable successive consumption of the developer from near the developing roller 43Y.

The partition 200 may include a first section 210, a second section 220, and a third section 230. The first section 210 extends vertically from the bottom of the base frame 110. The second section 220 is bent from an upper end of the first section 210 toward the second developer receiving chamber 104 and defines a developer seat 222 on an upper surface thereof. The third section 230 extends vertically from the second section 220. An upper end of the third section 230 is bent toward the second developer receiving chamber 104 so as to come into close contact with the cover 120.

A belt device 150 is arranged in the first developer receiving chamber 102 (see FIG. 2). The belt device 150 serves to deliver a part of the developer stored in the first developer receiving chamber 102 toward the developer seat 222 of the partition 200. In addition to performing delivery of the developer, the belt device 150 also serves to agitate the developer inside the first developer receiving chamber 102.

The belt device 150 includes a first rotator 152, a second rotator 154, and a developer delivery belt 156. The first rotator 152 and the second rotator 154 rotatably support the developer delivery belt 156. The developer delivery belt 156 rotates around the first rotator 152 and the second rotator 154 and delivers the developer stored in the first developer receiving chamber 102 to the developer seat 222 of the partition 200.

The first rotator 152 is positioned in the first developer receiving chamber 102 at a position adjacent to the partition 200. The second rotator 154 is arranged at an opposite side of the base frame 110 with respect to the first rotator 152 and with a predetermined distance therebetween.

The first rotator 152 rotates upon receiving power from a motor (not shown) mounted in the body 10 and supports one side of an inner surface of the developer delivery belt 156 to transmit rotation power to the developer delivery belt 156. The second rotator 154 supports the other side of the inner surface of the developer delivery belt 156 and is rotated together with the developer delivery belt 156.

The first rotator 152 and the second rotator 154 may include a spiral blade structure to agitate the developer stored in the first developer receiving chamber 102.

The developer delivery belt 156 may take the form of a film having a thickness of 2 mm or less and may be made of polyethylene terephthalate (PET), polycarbonate (PC), etc.

Using the belt for delivery of developer may simplify a developer delivery configuration even if the height of the developing device is reduced for a reduced size of the image forming apparatus and also, may reduce stress applied to the developer during delivery of the developer.

The first developer receiving chamber 102 and the second developer receiving chamber 104 communicate with each other through a developer supply port 224 perforated in the partition 200. The developer stored in the first developer receiving chamber 102 is delivered into the second developer receiving chamber 104 through the developer supply port 224 during operation of the developing device 40Y.

As shown in FIG. 4, the developer supply port 224 of the partition 200 may be formed at one end of the developer seat 222. A developer supply member 160 may be arranged on the partition 200 to deliver the developer present on the developer seat 222 toward the developer supply port 224.

The developer supply member 160 may take the form of an auger. The developer supply member 160 may include a delivery blade 162 extending along a length thereof to generate an axial delivery force, and a return blade 164 provided at an end of the developer supply member 160 at a position corresponding to the developer supply port 224.

The developer supplied to the developer seat 222 by the belt device 150 is delivered to one side of the partition 200 by the developer supply member 160 and thereafter, falls into the second developer receiving chamber 104 through the developer supply port 224.

After a sufficient amount of developer is supplied into the second developer receiving chamber 104 by the developer supply member 160, the developer is not introduced through the developer supply port 224 any more, and is returned into the first developer receiving chamber 102 by the return blade 164 of the developer supply member 160.

Figure 5:
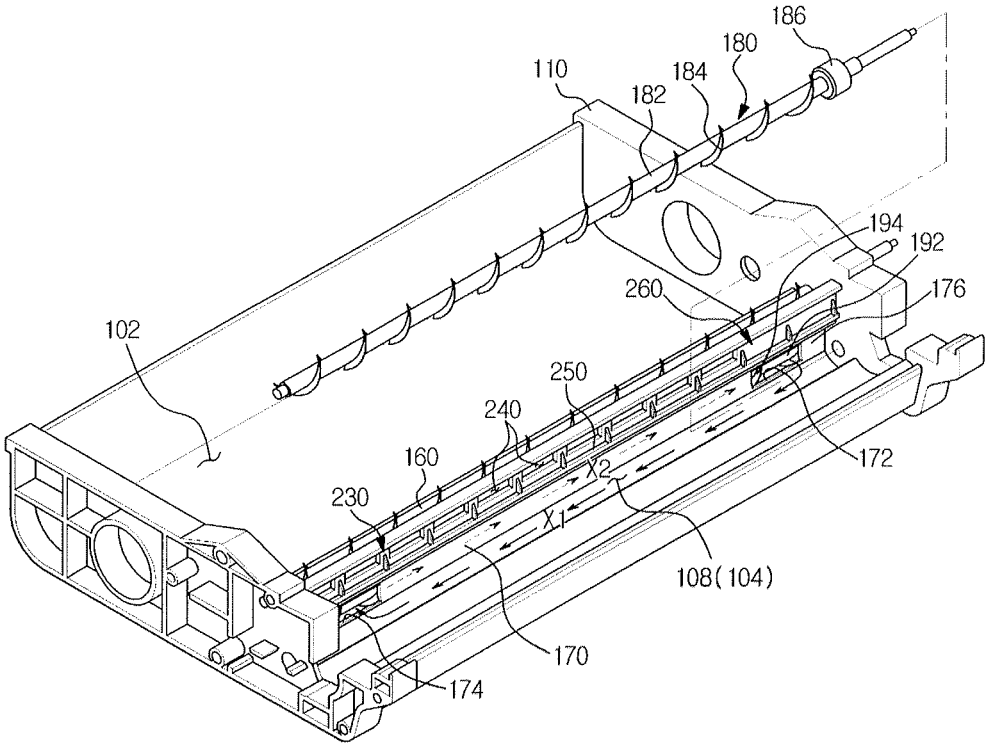
FIG. 5 is a perspective view illustrating some constituent elements of the developing device according to the embodiment of the present general inventive concept.
Figure 6:
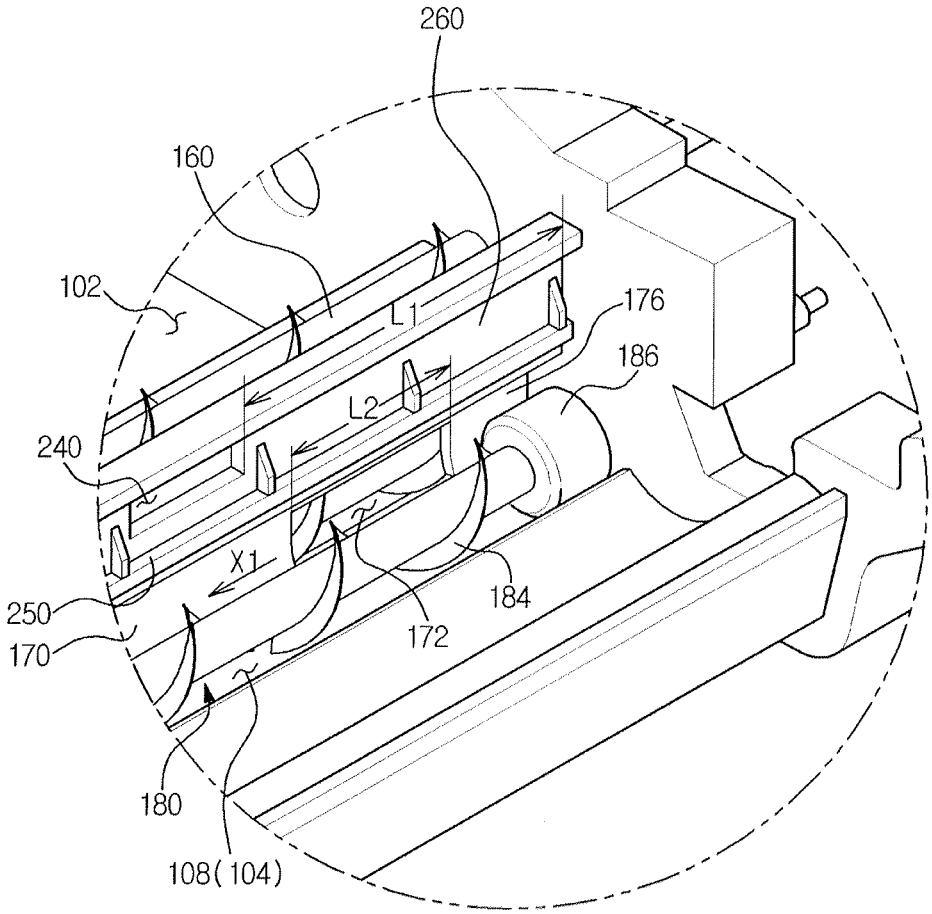
FIG. 6 is a partial enlarged view of FIG. 6

FIG. 5 is a perspective view illustrating some constituent elements of the developing device according to the embodiment of the present general inventive concept, and FIG. 6 is a partial enlarged view of FIG. 6.

As shown in FIGS. 3 and 5, the second developer receiving chamber 104 is divided into a developer delivery chamber 106 and a developing chamber 108 by a dividing wall 170. The developer delivery chamber 106 is located below the second section 220 of the partition 200, and communicates with the first developer receiving chamber 102 through the developer supply port 224. The third section 230 of the partition 200 is arranged between the first developer receiving chamber 102 and the developing chamber 108.

A developer delivery port 172 is perforated in one end of the dividing wall 170 to allow the developer to be moved from the developer delivery chamber 106 to the developing chamber 108. A developer circulation port 174 is perforated in the other end of the dividing wall 170 to allow the developer to be returned from the developing chamber 108 to the developer delivery chamber 106.

The developing roller 43Y, the supply roller 42Y, and a first developer delivery member 180 are arranged in the developing chamber 108, and a second developer delivery member 190 is arranged in the developer delivery chamber 106. The first developer delivery member 180 and the second developer delivery member 190 are rotatably supported at opposite side surfaces of the base frame 110.

Once the developer is supplied into the developing chamber 108 through the developer delivery port 172, the first developer delivery member 180 delivers the developer in a first direction (designated by the arrows X1), thereby allowing the developer to be supplied to the developing roller 43Y by way of the supply roller 42Y. The developer supplied to the developing roller 43Y defines a layer of developer and the developer layer is leveled by a regulator (128, see FIG. 2). As the developer layer is attached to the surface of the photosensitive body 44Y on which the electrostatic latent image has been formed by the light scanning device 30Y, formation of a visible image is accomplished. In this case, a part of the developer, which reaches the developer circulation port 174 rather than being supplied to the photosensitive body 44, is returned into the developer delivery chamber 106 through the developer circulation port 174.

The first developer delivery member 180 may include a delivery shaft 182 and a delivery blade 184 spirally formed on the delivery shaft 182 in an axial direction of the delivery shaft 182. A sealing member 186 may be coupled to an end of the delivery shaft 182 at a position adjacent to the developer delivery port 172. The sealing member 186 prevents the developer from leaking out of the developing device 40Y through a penetration hole of the delivery shaft 182 perforated in the base frame 110.

In addition to the developer that is returned into the developer delivery chamber 106 through the developer circulation port 174, the developer supplied into the developer delivery chamber 106 through the developer supply port 224 is delivered toward the developer delivery port 172 in a second direction (designated by the arrows X2) by the second developer delivery member 190.

Although not shown, the second developer delivery member 190 may include a delivery shaft 192 and a delivery blade 194 spirally formed on the delivery shaft 192 in an axial direction of the delivery shaft 192.

Although FIGS. 3 to 5 illustrate the developer supply member 160, the first developer delivery member 180, the second developer delivery member 190, the supply roller 42Y and the developing roller 43Y, all of which constitute a mechanism to supply the developer toward the photosensitive body 44Y, by way of example, other developer supply mechanisms may also be used. For example, the developer supply member 160 and the developer delivery members 180 and 190 in the form of augers shown in FIG. 2 may be replaced by other shapes and types of delivery members.

As shown in FIGS. 3 to 5, the partition 200 includes openings 240 to communicate the first developer receiving chamber 102 and the second developer receiving chamber 104 with each other.

When the developer is charged into the first developer receiving chamber 102 of the developing device 40Y, a part of the developer may be charged into the second developer receiving chamber 104 through the openings 240 of the partition 200. Accordingly, the opening 240 may prevent deterioration in fluidity of the developer despite an increased pressure in the developing chamber 108, thereby preventing deterioration in print quality.

For example, if a consumption amount of the developer in the developing chamber 108 is low due to a small amount of letters or other data being printed on the printing medium, the pressure in the developing chamber 108 increases, causing deterioration in fluidity of the developer. The deteriorated fluidity of the developer prevents efficient frictional charge during delivery of the developer, deteriorating electric-charge characteristics of the developer and causing print failure due to the developer being attached to an unexpected region other than the intended light scanning region of the photosensitive body 44Y. However, the openings 240 of the partition 200 prevent the pressure increase of the developing chamber 108, preventing print failure due to the increased pressure of the developing chamber 108.

The openings 240 may be formed in the third section 230 of the partition 200 and may be arranged in the first direction as a developer delivery direction of the first developer delivery member 180.

As shown in FIG. 5, an anti-backflow member 250 may be provided below the openings 240. The anti-backflow member 250 protrudes from the third section 230 of the partition 200 into the developing chamber 108, thereby preventing the developer from flowing backward from the developing chamber 108 into the first developer receiving chamber 102 through the openings 240.

Although FIGS. 4 and 5 illustrate an example wherein the plurality of openings 240 is formed in the partition 200 in the first direction, alternatively, only one opening may be formed, or a plurality of slits may be arranged vertically.

As shown in FIGS. 4 to 6, the partition 200 includes a shield 260, which blocks between the first developer receiving chamber 102 and the second developer receiving chamber 104 at an upstream position of the first direction X1, i.e., of the developer delivery direction of the first developer delivery member 180, so as to isolate the two developer receiving chambers 102 and 104 from each other. The shield 260 may be formed in one end of the third section 230 of the partition 200.

The shield 260 prevents the developer of the first developer receiving chamber 102 from flowing upstream of the first developer delivery member 180 without passing through the developer supply member 160 and the second developer delivery member 190. If the developer of the first developer receiving chamber 102 flows upstream of the first developer delivery member 180 without successively passing through the developer supply member 160 and the second developer delivery member 190, insufficiently frictionally charged developer may be supplied to the developing roller 43Y, causing print failure. However, providing the partition 200 with the shield 260 at the upstream position of the first direction X1 can prevent the insufficiently frictionally charged developer of the first developer receiving chamber 102 from directly flowing into the first developer delivery member 180, thereby preventing print failure.

As shown in FIG. 6, the shield 260 may be formed at a position corresponding to the developer delivery port 172 of the dividing wall 170. The shield 260 serves as a guide to efficiently deliver the developer in the first direction X1 when the first developer delivery member 180 delivers the developer having passed through the developer delivery port 172.

If the first developer delivery chamber 102 and the developing chamber 108 communicate with each other near the developer delivery port 172 where a larger amount of the developer is concentrated than other regions, the first developer receiving chamber 102 absorbs delivery pressure of the first developer delivery member 180, causing a weak delivery force in the first direction X1 and deepening concentration of the developer near the developer delivery port 172. However, by isolating the first developer receiving chamber 102 and the developing chamber 108 from each other at a position corresponding to the developer delivery port 172 by means of the shield 260, the developer near the developer delivery port 172 may be efficiently delivered in the first direction X1.

As illustrated in FIG. 6, a length L1 of the shield 260 may be longer than a length L2 of the developer delivery port 172 with respect to the first direction X1.

The dividing wall 170 may include a barrier 176 arranged at a position corresponding to the sealing member 186 of the first developer delivery member 180.

A portion of the first developer delivery member 180 where the sealing member 186 is mounted has a lower delivery force than the remaining portion of the first developer delivery member 180 where the delivery blade 184 is formed. With this configuration, when the developer is supplied toward the sealing member 186, the developer may be concentrated near the sealing member 186, causing print failure.

In view of the above possible over concentration near the sealing member 186, the barrier 176 prevents the developer of the developer delivery chamber 106 from being directly supplied to the sealing member 186 of the first developer delivery member 180, thereby serving to prevent concentration of the developer at the sealing member 186. Moreover, even if the developer reaches near the sealing member 186, the barrier 176 serves to guide smooth movement of the developer in the first direction X1.

Although the above described embodiment exemplifies that a single developer delivery member 180 is arranged in the developing chamber 108 and the shield 260 is provided at one side of the partition 200, two or more developer delivery members may be arranged in the developing chamber 108 and two shields 260 may provided at opposite sides of the partition 200.

As is apparent from the above description, according to embodiments of the present general inventive concept, it may be possible to prevent developer from being concentrated at a predetermined interior region of a developer receiving chamber. This may prevent deterioration in electric charge characteristics of developer.

Further, it may be possible to prevent print failure caused when insufficiently electrically charged developer is supplied to a photosensitive body.

Although a few embodiments have been shown and described, it would be appreciated by those skilled in the art that changes may be made in these embodiments without departing from the principles and spirit of the inventive concept, the scope of which is defined in the claims and their equivalents.

What is claimed is:

1. A developing device usable with an image forming apparatus, the developing device comprising:

a housing in which a developer receiving chamber is defined;

a partition to divide the developer receiving chamber into a first developer receiving chamber and a second developer receiving chamber; and a first developer delivery member arranged in the second developer receiving chamber to deliver developer in a first direction, wherein the partition includes a developer supply port disposed at one end thereof to allow the developer to be supplied from the first developer receiving chamber to the second developer receiving chamber during operation of the developing device, at least one opening also to allow the developer to be supplied from the first developer receiving chamber to the second developer receiving chamber, the at least one opening being spaced apart from the developer supply port, and a shield to block between the first developer receiving chamber and the second developer receiving chamber at an upstream position of the first direction, the shield being disposed at an opposite end of the partition with respect to the developer supply port so as to isolate the two developer receiving chambers from each other.

2. The developing device according to claim 1, further comprising:

a second developer delivery member arranged in the second developer receiving chamber to deliver the developer in a second direction so as to transmit the developer to the first developer delivery member; and a developer delivery port to communicate downstream of the second developer delivery member with upstream of the first developer delivery member, wherein the shield is formed at a position corresponding to the developer delivery port.

3. The developing device according to claim 2, wherein a length of the shield is longer than a length of the developer delivery port with respect to the first direction.

4. The developing device according to claim 2, further comprising a barrier arranged at a position corresponding to an upstream end of the first developer delivery member between the first developer delivery member and the second developer delivery member.

5. The developing device according to claim 1, wherein:

the partition includes a first section extending vertically from the bottom of the housing, a second section bent from the first section to divide the developer receiving chamber vertically, and a third section extending vertically from the second section; and the shield is formed at one end of the third section with respect to the first direction.

6. The developing device according to claim 5, wherein the at least one opening is formed in the third section.

7. The developing device according to claim 1, wherein the at least one opening includes a plurality of openings arranged in the first direction.

* * * * *